US009072941B2

(12) United States Patent
Duda et al.

(10) Patent No.: US 9,072,941 B2
(45) Date of Patent: Jul. 7, 2015

(54) EXOSKELETON SUIT FOR ADAPTIVE RESISTANCE TO MOVEMENT

(75) Inventors: Kevin R. Duda, Watertown, MA (US); Douglas J. Zimpfer, Houston, TX (US); Seamus T. Tuohy, Newton, MA (US); John J. West, Weston, MA (US)

(73) Assignee: THE CHARLES STARK DRAPER LABORATORY, INC., Cambridge, MA (US)

( * ) Notice: Subject to any disclaimer, the term of this patent is extended or adjusted under 35 U.S.C. 154(b) by 209 days.

(21) Appl. No.: 13/308,132

(22) Filed: Nov. 30, 2011

(65) Prior Publication Data

US 2013/0040783 A1 Feb. 14, 2013

Related U.S. Application Data

(60) Provisional application No. 61/522,347, filed on Aug. 11, 2011.

(51) Int. Cl.

| | |
|---|---|
| ***A63B 71/00*** | (2006.01) |
| ***A63B 21/02*** | (2006.01) |
| ***A63B 21/22*** | (2006.01) |

(Continued)

(52) U.S. Cl.

CPC ..... *A63B 21/22* (2013.01); *A63B 69/0057* (2013.01); *A63B 71/0622* (2013.01); *A63B 21/0058* (2013.01); *A63B 21/1423* (2013.01); *A63B 21/1434* (2013.01); *A63B 21/1449* (2013.01); *A63B 21/1484* (2013.01); *A63B 21/225* (2013.01); *A63B 22/0235* (2013.01); *A63B 23/03541* (2013.01); *A63B 23/03575* (2013.01); *A63B 2021/222* (2013.01); *A63B 2022/0092* (2013.01); *A63B 2071/0655* (2013.01); *A63B 2220/16* (2013.01); *A63B 2220/34* (2013.01); *A63B 2220/40* (2013.01); *A63B 2225/50* (2013.01);

(Continued)

(58) Field of Classification Search

USPC ..... 482/1, 5, 6, 8, 9

See application file for complete search history.

(56) References Cited

U.S. PATENT DOCUMENTS

| | | | | |
|---|---|---|---|---|
| 8,002,670 | B2 * | 8/2011 | Kadota | 482/5 |
| 2006/0004307 | A1 * | 1/2006 | Horst | 601/5 |

(Continued)

OTHER PUBLICATIONS

Bloomberg, J. J. and A. P. Mulavara (2003). "Changes in Walking Strategies after Spaceflight." IEEE Engineering in Medicine and Biology Magazine(Mar./Apr.): 58-62.

(Continued)

*Primary Examiner* — Loan H Thanh
*Assistant Examiner* — Shila Jalalzadeh Abyan
(74) *Attorney, Agent, or Firm* — Edward A. Gordon; Foley & Lardner LLP

(57) ABSTRACT

Systems and methods are disclosed herein for providing resistance to movement of a wearer. The system includes a plurality of wearable actuators, a plurality of wearable sensors, and a processor. Each of the wearable sensors measures an indication of an orientation of a corresponding one of the wearable actuators with respect to a vertical direction. Each of the sensors also measures an indication of a motion experienced by the corresponding one of the wearable actuators. The processor receives data from each sensor indicating the orientation and the motion of the sensor. The processor determines an amount of resistance to apply using each of the actuators based on the vertical direction and sends instructions to the actuators. The instructions cause the actuators to apply a resistance to the wearer.

17 Claims, 6 Drawing Sheets

(51) Int. Cl.

| | |
|---|---|
| ***A63B 69/00*** | (2006.01) |
| ***A63B 71/06*** | (2006.01) |
| ***A63B 21/005*** | (2006.01) |
| ***A63B 21/00*** | (2006.01) |
| ***A63B 23/035*** | (2006.01) |
| ***G08B 21/02*** | (2006.01) |
| ***G08B 21/04*** | (2006.01) |
| *A63B 22/02* | (2006.01) |
| *A63B 22/00* | (2006.01) |

(52) U.S. Cl.
CPC ..... *G08B 21/0266* (2013.01); *G08B 21/0453* (2013.01); *G08B 21/0469* (2013.01)

(56) References Cited

U.S. PATENT DOCUMENTS

| | | | | |
|---|---|---|---|---|
| 2007/0135279 | A1* | 6/2007 | Purdy et al. | 482/124 |
| 2007/0265140 | A1* | 11/2007 | Kim et al. | 482/8 |
| 2008/0214949 | A1* | 9/2008 | Stivoric et al. | 600/549 |
| 2008/0223131 | A1* | 9/2008 | Vannucci et al. | 73/510 |
| 2010/0179668 | A1* | 7/2010 | Herr et al. | 623/51 |
| 2012/0094814 | A1* | 4/2012 | Atkins et al. | 482/142 |

OTHER PUBLICATIONS

Bloomberg, J. J., A. P. Mulavara, et al. (2001). Locomotion after long-duration spaceflight: Adaptive modulation of a full-body head and gaze stabilization system. Bioastronautics Investigators' Workshop, Galveston, Texas.

Carr, C. E. and D. J. Newman (2008). "Characterization of a lower-body exoskeleton for simulation of space-suited locomotion." Acta Astronautica 62(4-5): 308-323.

Convertino, V. A. (1996). "Exercise as a countermeasure for physiological adaptation to prolonged spaceflight." Medicine and Science in Sports and Exercise 28(8): 999-1014.

Coolahan, J. E., A. B. Feldman, et al. (2004). Integrated Physiological Simulation of an Astronaut Exercise Protocol. 55th International Astronautical Congress, Vancouver, Canada.

Duda, J. E., D. J. Newman, et al. (2011). The Use of Artificial Muscles in Space Suit Simulation for Partial Gravity Experimentation and Training. IEEE/AIAA Aerospace Conference, Big Sky, MT.

Flanders, M., J. M. Hondzinski, et al. (2003). "Using arm configuration to learn the effects of gyroscopes and other devices." J Neurophysiol 89(1): 450-9.

Hibbeler, R. C. (1998). Chapter 21: Three-Dimensional Kinetics of a Rigid Body. Engineering Mechanics: Dynamics. Saddle River, NJ, Prentice-Hall.

Iberall, A. S. (1970). "The Experimental Design of a Mobile Pressure Suit." Journal of Basic Engineering: 251-264.

Lackner, J. R. (2008). Somatosensory Suppression and Prevention of Post-Flight Reentry Disturbances of Posture and Locomotion, NSBRI (PI: J. Lackner, Brandeis University).

LeBlanc, A., C. Lin, et al. (2000). "Muscle volume, MRI relaxation times (T2), and body composition after spaceflight." Journal of Applied Physiology 89(6): 2158-64.

LeBlanc, A., V. Schneider, et al. (2000). "Bone mineral and lean tissue loss after long duration space flight." J Musculoskelet Neuronal Interact 1(2): 157-60.

Newman, D. J. (2005). Astronaut Bio-Suit System for Exploration Class Missions. NIAC Phase II Bimonthly Report. Cambridge, MA, Massachusetts Institute of Technology.

Nicogossian, A., C. F. Sawin, et al. (1994). Chapter 11: Physiologic adaptation to space flight. Space Physiology and Medicine. A. Nicogossian, C. L. Huntoon and S. L. Pool. Philadelphia, Lea & Fibiger.

NSBRI. (2011). "Research Areas: National Space Biomedical Research Institute." Retrieved Apr. 19, 2011, from http://www.nsbri.org/Research/index.html.

Oganov, V. and V. S. Schneider (1996). Skeletal system. Space Biology and Medicine. A. Nicogossian and O. G. Gazenko. Reston, VA, American Institute of Aeronautics and Astronautics: 247-266.

Oman, C. M. (2003). Chapter 19: Human Visual Orientation in Weightlessness. Levels of Perception. L. R. Harris and M. Jenkin. New York, Springer-Verlag: 375-395.

Paloski, W. H., M. F. Reschke, et al. (1999). Recovery of Postural Equilibrium Control Following Space Flight (DSO 605). Extended duration orbiter medical project final report 1989-1995. NASA SP-1999-534. C. F. Sawin, G. R. Taylor and W. L. Smith: 5.4-1—5.4-16.

Waldie, J. M. and D. J. Newman (2011). "A gravity loading countermeasure skinsuit." Acta Astronautica 68(7-8): 722-730.

Wikipedia. (2011). "Control Moment Gyroscope." Retrieved Apr. 8, 2011.

Yeadon, M. R. (1990). "The simulation of aerial movement—II. A mathematical inertia model of the human body." Journal of Biomechanics 23(1): 67-74.

Young, L. R., D. K. Jackson, et al. (1992). "Multisensory Integration in Microgravity." Annals of the New York Academy of Sciences 656: 340-353.

* cited by examiner

EXOSKELETON SUIT FOR ADAPTIVE RESISTANCE TO MOVEMENT

CROSS REFERENCE TO RELATED APPLICATIONS

This application claims the benefit of U.S. Provisional Application No. 61/522,347, "Exoskeleton suit for body movement characterization and coordination," filed Aug. 11, 2011, which is hereby incorporated by reference herein in its entirety.

FIELD OF THE INVENTION

In general, the invention relates to systems and methods for providing adaptive resistance to movement.

BACKGROUND OF THE INVENTION

Exposure to the weightless environment of space results in sensorimotor adaptation and physiological de-conditioning with commensurate impacts on astronauts' coordination and abilities to perform physical tasks. The sensorimotor effects are most apparent during critical maneuvering phases of a mission, when physical performance, coordination, and multi-sensory perception are most critical to mission safety and success. Since there are no gravitational "down" cues in space and visual cues may be ambiguous, self-orientation perception with respect to a spacecraft cabin or other weightless environment is constantly changing and may be volitionally commanded. This can lead to difficulty in teleoperation, berthing, or docking tasks, which require the integration of sensory information from multiple reference frames and bimanual coordination. This lack of a common reference direction within the environment or between astronauts may also lead to performance degradation during navigation tasks such as module-to-module locomotion or emergency egress.

Some of the observed sensorimotor effects, such as spatial disorientation and space motion sickness, may be attributed to the initial exposure to weightlessness. Other effects of being in a weightless environment, such as gate ataxia and posture stabilization, have been observed following the transition to a gravitational environment following spaceflight. There currently is no equipment or protocol to facilitate the sensorimotor adaptation from one gravitational environment to another. The sensorimotor effects inhibit astronauts' performance efficacy as they undergo an adaptation period following a transition to weightlessness (following Earth- or partial-G) or a transition back to Earth- or partial-G (following weightlessness).

Exposure to the weightless environment of space also has negative impacts on human health in the long term. In the long term, weightlessness leads to muscle atrophy, muscle strength loss, and skeletal deterioration. To counteract the long term effects, astronauts use time-consuming in-flight exercise regimens to address this loss of muscle strength and bone mass. Compression suits may be worn in an attempt to counteract the physiological de-conditioning, but they are not responsive to their wearer's motions. They do not provide any directional or coordinational movement guidance. Thus, when astronauts engage in physical activities, they have no resistance to undesirable or inappropriate movements. Because the weightless environment of space affects astronauts' motion control and posture stabilization, it can take significantly longer for astronauts to perform physical tasks than it would in an environment with Earth gravity.

Powered exoskeletons for use on land have been developed to augment the strength and endurance of their wearers. However, powered exoskeletons are not intended to provide resistance to movement. Furthermore, powered exoskeletons require a substantial amount of energy for a measured improvement in human strength or endurance.

SUMMARY

Therefore, there is a need in the art for a wearable system for replicating the effects of gravity for a person in a weightless environment. Replicating the effects of gravity gives astronauts increased motion control, so that they can perform physical operations with greater speed and precision upon the transition to weightlessness. Furthermore, replicating the sensation of gravity in space greatly reduces or even eliminates the need for in-flight exercise regimens and facilitates the transition back to an environment with gravity. This not only saves astronauts' time, but it also provides operational performance benefits and reduces the weight and space required for on-board exercise equipment. One way to replicate gravity is to attach actuators, such as gyroscopes, to the limbs of the wearer to apply "downward" forces, i.e., forces that replicate the force of gravity on the Earth, during the wearer's movements. The actuators can be attached to a body-worn space suit, which rigidly attaches the actuators to the limbs. The power requirement of the actuators is less than the power requirement of typical exoskeletons for strength and endurance augmentation, and the form factor is smaller than those exoskeletons, allowing for greater ease of use and minimal interference in the wearer's activities.

In some embodiments, the actuators provide resistance to particular movements of a wearer. In space, the actuators provide resistance to "upward" movements, i.e., movements that would correspond to movements opposite the direction of gravity on Earth. In a weightless environment, providing an external "down" cue by resisting upward movements alleviates difficulties caused by changing self-perception of orientation. Since there is no universal "down" cue in space, the actuators may be configured and actuated so that the direction of "down" with respect to the body can be customized. In some embodiments, the suit is worn by a person undergoing physical rehabilitation after spaceflight, injury, disability, or a prolonged confinement to bed. In such embodiments, the actuators provide resistance to undesirable movements but provide no resistance to biomechanically desirable movements, such as walking movements. Thus, the wearer receives feedback that encourages the correct motions.

In other embodiments, a suit or a partial suit is worn by a person in an industrial environment to prevent harm to the person or equipment by providing resistance to movement into a spatial region. For example, when the suit senses that its wearer is nearing a dangerous piece of equipment, the suit warns the wearer of the danger of further movement in that direction. In other embodiments, the suit is worn by a person learning a physical activity, such as ballroom dancing or martial arts, and provides guidance in learning the proper form. In yet other embodiments, the suit is worn by gamers to provide enhanced interactivity. In each of these embodiments, the suit gathers real-time position information of the wearer and provides tactile feedback to the wearer.

Accordingly, systems and methods are disclosed herein for providing resistance to movement. The system includes a plurality of wearable sensors, a plurality of wearable actuators, and a processor. Each of the wearable sensors measures an indication of an orientation of a corresponding one of the wearable actuators with respect to a vertical direction. Each of the sensors also measures an indication of a motion experienced by the corresponding one of the wearable actuators. The processor receives data from each sensor indicating the orientation and the motion of the sensor. The processor determines an amount of resistance to apply using each of the actuators based on the received data and vertical direction and sends instructions to the actuators. The instructions cause the actuators to apply a resistance to the wearer.

In some embodiments, each of the sensors is configured to measure a magnitude and a direction of the motion. In some embodiments, the processor determines positions of each of the sensors in relation to each of the other sensors based on data from each of the sensors. The processor can determine the amount of resistance to apply using the actuators based on the relative position of the sensors.

In some embodiments, the system includes a sensor for identifying the vertical direction. In other embodiments, the system includes a user interface with which the user can input the vertical direction. In some embodiments, the system includes a wearable power source coupled to the plurality of actuators and the processor. Each actuator can include an electric motor coupled to a flywheel, so that the electric motor controls the speed of the flywheel. The instructions sent to an actuator can include instructions indicating a rotation rate of the flywheel and an orientation of the flywheel.

In some embodiments, each of the actuators is rigidly attached to a limb of the wearer. The system can include at least one mounting beam for positioning proximate to the limb of the wearer. An actuator can be mounted on the mounting beam, so that the actuator is rigidly attached to the limb of the wearer. In some embodiments, the plurality of sensors and the plurality of actuators are mounted on a body suit.

According to another aspect, the invention relates to a similar system for providing resistance to movement that involves a reference direction rather than a vertical direction. The system includes a plurality of wearable sensors, a plurality of wearable actuators, and a processor. Each of the wearable sensors measures an indication of an orientation of a corresponding one of the wearable actuators with respect to the reference direction. Each of the sensors also measures an indication of a motion experienced by the corresponding one of the wearable actuators. The processor receives data from each sensor indicating the orientation and the motion of the sensor. The processor determines an amount of resistance to apply using each of the actuators based on the received data and reference direction and sends instructions to the actuators. The instructions cause the actuators to apply a resistance to the wearer.

In some embodiments, the processor causes the plurality of actuators to provide a no-resistance envelope for a particular movement. In some embodiments the processor is further causes the actuators to provide a resistance curriculum to assist in physical rehabilitation of the wearer. The processor can cause the actuators to assist in gait stabilization of a wearer.

In some embodiments, the processor causes the plurality of actuators to limit the wearer from moving in a particular area. Limiting the wearer from moving in a particular area can involve providing, by one or more actuators, resistance to movement in the direction of the area. Limiting the wearer from moving in a particular area can alternatively or additionally involve communicating a warning to the wearer indicating the danger of moving in the direction of the area. A pulsed resistance to movement in the direction of the area can be used to communicate the warning to the wearer.

DETAILED DESCRIPTION

To provide an overall understanding of the invention, certain illustrative embodiments will now be described, including wearable systems and methods for providing resistance to movement. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope thereof.

Figure 1:
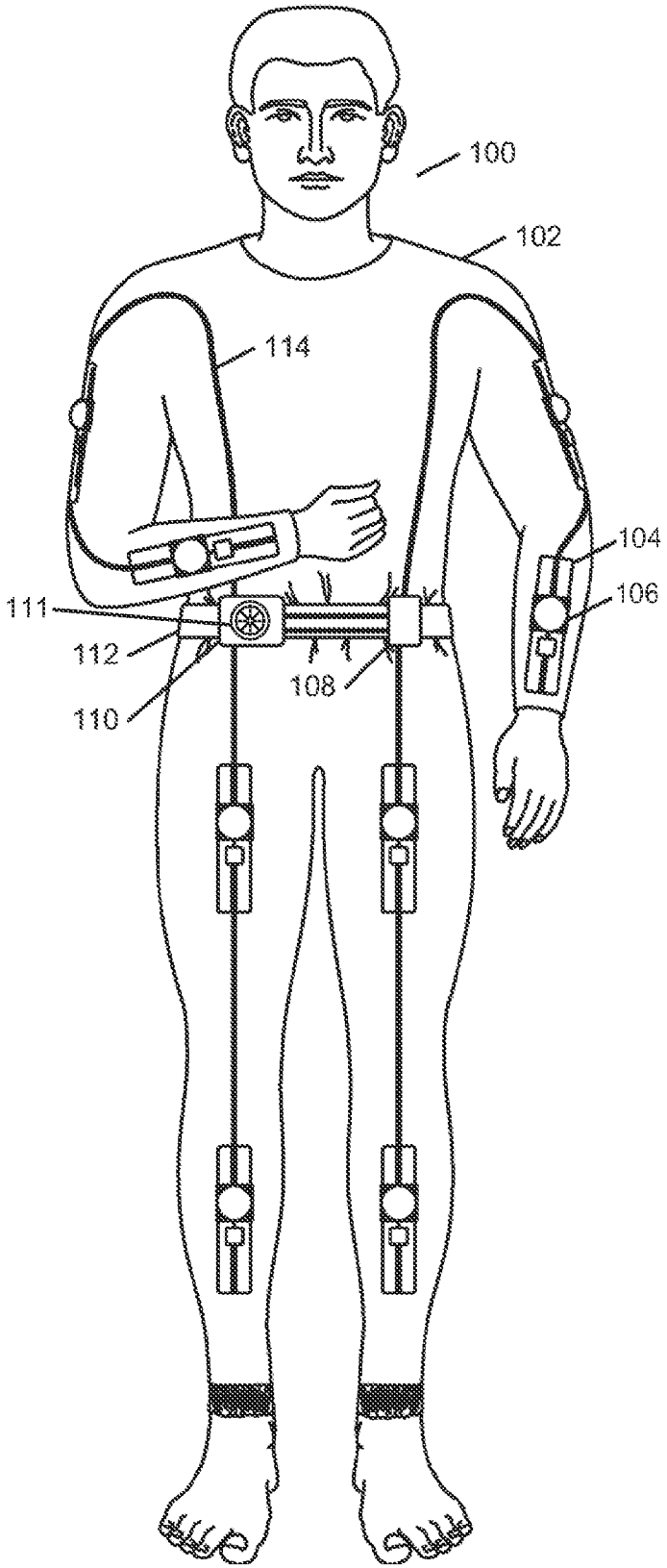
FIG. 1 shows a conceptual diagram of a person wearing an exoskeleton suit for providing resistance to movement, according to an illustrative embodiment of the invention.

FIG. 1 shows a wearer 100 wearing an exoskeleton suit 102 that uses sensors and actuators to detect the movement and orientation of the wearer's limbs and, in response, provide resistance to certain types of motions. The suit 102 has a plurality of mounted actuator attachments 104 rigidly attached to the suit 102. Each actuator attachment 104 includes a sensor, such as an inertial measurement unit, to detect limb orientation and movement. Each actuator attachment 104 also includes at least one actuator, such as a gyroscope 106, to provide resistance against certain motions. The actuator attachments 104 have rigid support rods or rigid backings along the axis of the bones of the limb segments of the wearer 100. The rigid support rods in the attachments 104 may be contoured to follow the body shape so that they are worn comfortably during movements. The rigid support rods or backings apply the resistance to greater areas of the wearer's limbs than just the area of the actuators, and help maintain the position and orientation of the sensors with respect to the actuators. When possible, the rigid support rods or backings are aligned in parallel to the direction of minimal stretch of the skin of the wearer 100, which is also the direction of minimal stretch of the suit 102 when worn by the wearer 100. The actuators 106 are also positioned on the suit 102 to minimize interference during body movements. In some embodiments, the actuators 106 are positioned near the center of mass of each limb segment. The actuator attachments 104 are described in greater detail below in relation to FIG. 2.

The suit 102 can be made out of any material suitable for mounting the actuator attachments 104 and that provides sufficient mobility of its wearer. For example, the suit 102 can be made out of spandex, latex, neoprene, cotton, polyester, nylon, wool, acrylic, or any other suitable fabric or fabric blend. Form-fitting or skintight fabrics, e.g., fabrics containing spandex and/or latex, aid in the positioning of the actuator attachments 104 and their effectiveness in applying resistance to the wearer. These skintight fabrics also enable contoured rigid support rods or rigid backings of the actuator attachments 104 to be worn in close contact to the skin. The suit 102 may contain low-profile aluminum beams, carbon fiber beams, or other beams for adding rigidity. The suit 102 may be a compression suit, particularly for weightless environments, to help counteract bone loss and/or assist in cardiovascular conditioning. For certain industrial settings or other dangerous environments, the suit 102 is made of a protective fabric, e.g., fire-resistant fabric, such as NOMEX; fire proximity fabric, such as aluminized fabric; cut and abrasion resistant fabric, such as SUPERFABRIC; or radiation-blocking fabric, such as DEMRON. For applications in which the wearer may suffer impacts, the suit 102 can include padding or guards. For applications in which the wearer is in extreme weather conditions, the suit 102 provides ventilation or insulation for the wearer. In some embodiments, the suit 102 is designed to fit over or underneath additional outerwear for added warmth or protection. For example, the suit 102 may be configured to fit underneath a spacesuit for extra-vehicular activity. The suit 102 can be otherwise adapted for the particular environment of its intended wearer.

A processing unit 108 and a power unit 110 are attached to the suit 102 by a belt 112. The processing unit 108 receives data from the sensors of the actuator attachments 104. The processing unit 108 processes the received data to determine a resistance for each of the actuators 106 to apply to the wearer 100. The processing unit 108 then sends instructions to the actuators 106 to apply the calculated resistance. This process is discussed in further detail in relation to FIGS. 4 and 6. In some embodiments, the processing unit 108 includes a memory, such as a memory card, for storing data collected during operation of the suit 102. The processing unit 108 can connect to an external computing system (not shown) during or after operation of the suit 102 using a wired or wireless connection. The external computing system can provide post-processing, data analysis, data output, and software or firmware updates for the processing unit 108. The power unit 110 supplies power to the processing unit 108 and the actuator attachments 104. In some embodiments, rather than being two separate units, the processing unit 108 and power unit 110 are incorporated into a single unit. The processing unit 108 and/or power unit 110 can be attached to the suit 102 in any other means, and can be attached at other locations on the suit 102. For example, the processing unit 108 and/or power unit 110 can be housed in a backpack, placed in a pocket of the suit 102, or attached to the suit 102 using VELCRO. In some embodiments, rather than having a wearable processing unit 108 and power unit 110, the suit 102 is tethered to an external power source and/or an external processing unit.

In FIG. 1, the processing unit 108 communicates with the actuator attachments 104 through cables 114. The wires pass through the actuator attachments 104 on the upper arms and upper legs of the suit 102 to reach the actuator attachments 104 on the forearms and shins of the suit 102. The belt 112 has cables 114 passing from left to right to send signals from the left side of the wearer 100 where the processing unit 108 is located to the right side of the wearer 100. As shown, the belt 112 has two cables passing through it, with the upper wire leading to the actuator attachments 104 on the right arm of the suit 102 and the lower wire leading to the actuator attachments 104 on the right leg of the suit 102. Rather than a two separate cables, a single cable can be used to transmit signals across the belt 112. In FIG. 1, the cables 114 are depicted as being on top of the suit 102. In other embodiments, the cables 114 are sewn into the suit 102 or underneath the suit 102.

The same cables 114 also connect the power unit 110 to the actuator attachments 104. Thus, each cable 114 contains at least a signal transmission wire for passing signals between the processing unit 108 and the actuator attachments 104 and a power transmission wire for powering the actuator attachments 104 and/or the processing unit 108. The cables 114 are insulated to protect the wearer 100 and the cables 114. In some embodiments, each actuator attachment 104 has a devoted power source, so the power source 110 is only needed to provide power to the processing unit 108. In some embodiments, the actuator attachments 104 and the processing unit 108 include wireless transceivers for communicating wirelessly with each other. If the actuator attachments 104 have devoted power sources and the actuator attachments 104 and processing unit 108 have wireless transceivers, the suit 102 does not require cables 114. In yet other embodiments, each actuator attachment 104 has a dedicated processing unit, and each actuator attachment 104 communicates with the other actuator attachments 104 rather than communicating with the processing unit 108. In such an embodiment, each actuator attachment 104 determines the resistance that its actuator 106 should apply to the wearer 100.

The belt 112 can contain additional equipment for use with the suit 102, such as a dial 111 with which the wearer 100 can input a reference direction. The belt 112 can also hold equipment unrelated to the motion sensing and resistance feature. For example, the belt 112 may hold an environmental detection system (e.g., temperature or barometric sensors). The suit 102 can be able to detect its user's vital signs and communicate them to the processing unit 108 on the belt 112. The belt can hold a warning system to alert the wearer to undesirable environmental characteristics or vital signs. The belt 112 can additionally or alternatively contain a communications system for wirelessly communicating environmental conditions and/or the wearer's vital signs to another person or processing system.

In FIG. 1, the hands and the feet of the operator are bare. In other embodiments, the suit 102 covers the hands and/or the feet of the operator. The hands and/or feet of such a suit can include actuator attachments 104, which may be resized or reconfigured to be better suited for the hands or feet. In FIG. 1, the suit 102 has eight actuator attachments 104, and in other embodiments, the suit 102 has more or fewer actuator attachments 104. For example, each limb segment could have two, three, or more actuator attachments 104 for applying resistance on different sides or regions of the wearer's limb segments. In some embodiments, the suit 102 only covers a portion of the body. For example, in some embodiments, the suit 102 only covers one or both arms, e.g., for use in reaching movements; in other embodiments, the suit 102 only covers one or both legs, e.g., for use in walking.

Figure 2:
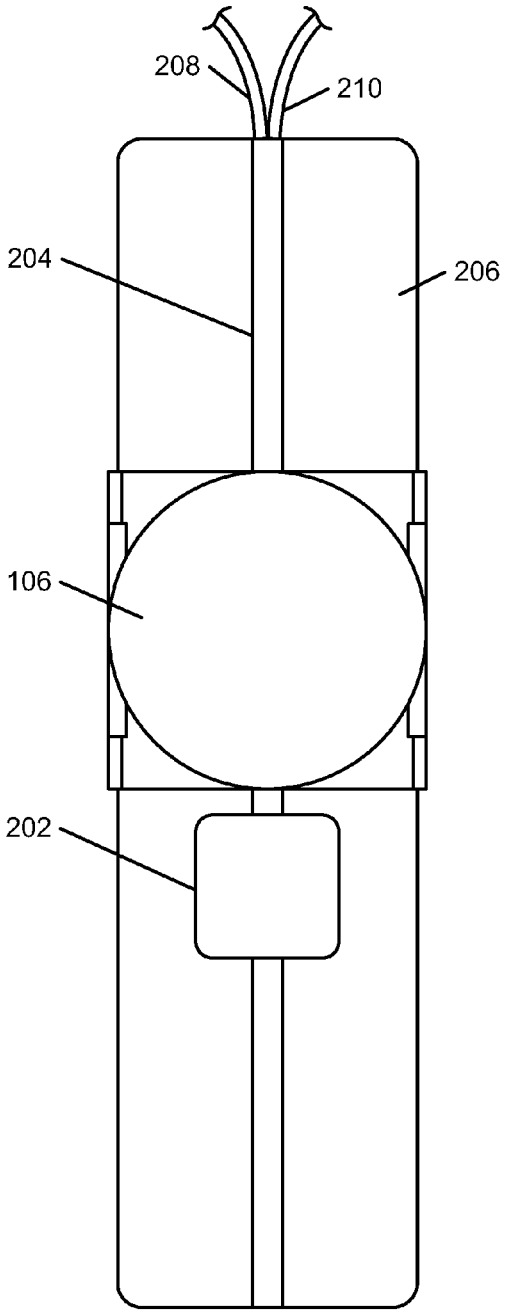
FIG. 2 is a top view of an actuator attachment for sensing the movement of a wearer and providing resistance to movements of the wearer of the exoskeleton suit of FIG. 1, according to an illustrative embodiment of the invention.

FIG. 2 is a top view of the actuator attachment 104 for sensing the movement of a wearer and providing resistance to movements of the wearer. The actuator attachment 104 consists of an actuator 106, a sensor 202, a rigid support rod 204, and a backing 206. The actuator attachment 104 also has a wired processing unit connection 208 to the processing unit 108 and a wired power connection 210 to the power unit 110. The wired connections 208 and 210 pass through the rigid support rod 204 or underneath the actuator attachment 104 to give the suit 102 a low profile and to reduce the risk of the wires or cables 114 getting caught when a wearer moves. The sensor 202 is an inertial measurement unit (IMU), which is an electronic device that measures angular velocity and linear acceleration using accelerometers and gyroscopes. From angular velocity and linear acceleration data, the processing unit 108 can determine the position, orientation, and movement of the sensor 202. In some embodiments, the IMU consists of three accelerometers and three gyroscopes. Rather than an IMU, a potentiometer or any other device for measuring velocity and acceleration can be used as the sensors 202. Sensors 202 of suits 102 for use on Earth may also include a gravity sensor and/or a compass for identifying a reference direction such as "down" or North. The processing unit 108 uses data collected by the sensors 202 and sent via the processing unit connection 208 to determine the position and orientation of each limb segment. Based on this information, the processing unit 108 sends commands via the processing unit connection 208 to the actuator 106. The actuator 106, which receives power from the power connection 210, applies resistance to a limb segment of a wearer 100 based on the commands from the processing unit 108. The actuator 106 is shown in greater detail in FIG. 3A and is described in detail in relation to FIGS. 3A through 3C.

The rigid support rod 204 is contoured to the shape of the user's limb. For example, since a user's quadriceps muscles typically contour outwards, the rigid support rod 204 of the upper leg attachment would be similarly contoured. If the backing 206 is rigid, it would be similarly contoured to the limb segment to which it is attached. Contouring the rigid components of the actuator attachment 104 help ensure both that the resistance is applied to a large area of the limb segment and that the actuator attachment 104 does not shift relative to the limb segment. The rigid elements of the actuator attachment 104 can be ductile or malleable, so that they can be shaped to the wearer 100 once the wearer 100 is wearing the suit 102. After being confirmed to the wearer 100, the rigid elements retain their given shape. In some embodiments, segments of suit 102 itself are made rigid, e.g., by impregnating the fabric of the suit 102 with an epoxy resin to stiffen the fabric. If the suit 102 itself is rigid, the rigid support rod 204 and/or backing 206 can be eliminated, and the sensor 202 and the actuator 106 can be attached directly to the stiffened suit 102.

In FIG. 2, the actuator attachment 104 only has wired connections 208 and 210 at its top end. Some actuator attachments 104, such as the actuator attachments 104 on the upper arms and upper legs of the suit 102 shown in FIG. 1, will also have the wires 208 and 210, possibly combined in a cable 114, extending out of the bottom of the actuator attachment 104 to attach to another actuator attachment 104. In this case, the cable 114 going into the top of the actuator attachment 104 can have at least four wires, two to connect to the upper actuator attachment and two to connect to the lower actuator attachment. In some embodiments, the power is supplied in series, and a single power wire 210 connects to both the upper and lower actuator attachments 104.

Figure 3A:
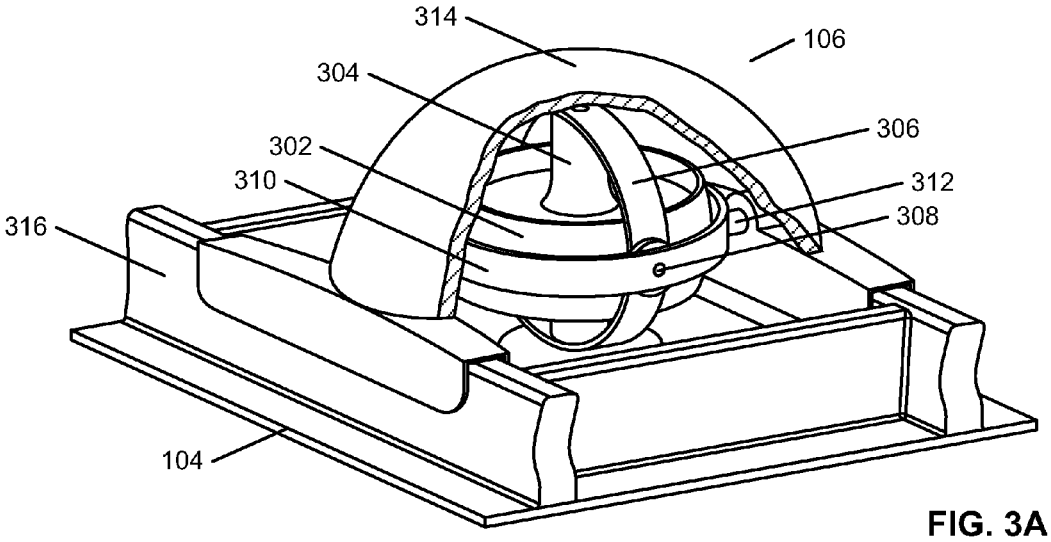
FIG. 3A is a perspective view of a flywheel gyroscope actuator for applying resistance to a wearer and for use in the actuator attachment of FIG. 2, according to an illustrative embodiment of the invention.

FIG. 3A is a perspective view of the actuator 106 for applying resistance to a wearer 100 as described in relation to FIGS. 1 and 2. The actuator 106 is a control moment gyroscope (CMG), in which both the magnitude and direction of resistance can be controlled by controlling the speed and the orientation of a flywheel 302. The flywheel 302 rotates about a flywheel axis 304. The CMG 106 also consists of gimbals 306 and 310 for changing the orientation of the flywheel 302, gimbal axes 308 and 312 for rotating the orientation of the gimbals 306 and 310, respectively, and flywheel cover 314 for shielding the CMG 106. The flywheel cover 314 covers the moving parts of the CMG 106 both to protect the CMG 106 and to protect the wearer and his environment from the potential harm caused by the moving parts. The CMG 106 is mounted onto the actuator attachment 104, a portion of which is shown in FIG. 3A, by mounting assembly 316.

A motor (not shown) causes the flywheel 302 to spin about the flywheel axis 304, also called the spin axis. The rotation creates an angular velocity and an angular momentum along the flywheel axis 304. The motor controls the speed of the flywheel 302, which is related to the angular momentum of the flywheel 302 and the amount of resistance provided by the CMG 106. Additional motors (not shown) are attached to the gimbals to adjust the orientation of the gimbals 306 and 310 and, in turn, the orientation of the flywheel axis 304 and the flywheel 302. In FIG. 2, there are two gimbals and two axes of rotation of the gimbals. This allows the flywheel 302 to have any orientation. Thus, the flywheel 302 can create angular momentum in any direction. The CMG 106 takes advantage of the conservation of the angular momentum of the flywheel 302. When spinning, the flywheel 302 resists changes to the orientation of the spin axis or flywheel axis 304. This causes a gyroscopic torque to be imparted on the attached mass, i.e., the limb segment to which the CMG 106 is mounted, through the actuator attachment 104. Since the flywheel 302 resists changes in the orientation of the flywheel axis 304, the limb segment to which the CMG 106 is mounted will feel a resistance when it attempts to move in a manner that would change the orientation of the flywheel axis 304. Thus, the wearer 100 would be able to translate a limb segment without resistance, but would feel a resistance when he tried to rotate the limb segment in certain directions.

Figure 3B:
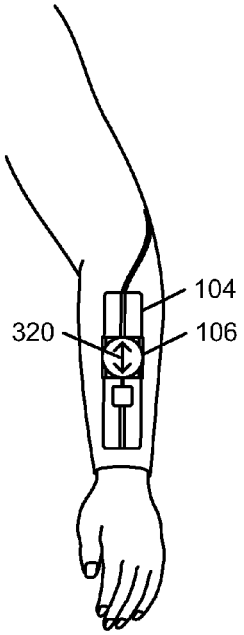
FIGS. 3B and 3C are two illustrations of gyroscope actuators having different flywheel orientations with respect to the forearm of a wearer, according to an illustrative embodiment of the invention.
Figure 3C:
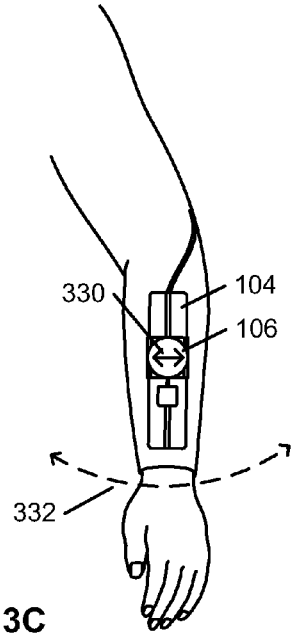

For example, imagine the CMG 106 is mounted to a wearer's forearm and the flywheel axis 304 is positioned parallel to the bones in the wearer's forearm. This arrangement is shown in FIG. 3B, in which the orientation of the flywheel axis 304 is indicated by arrow 320. In this case, if all of the wearer's other limbs are held still, the wearer 100 would feel a resistance to any movement of his forearm created by bending or straightening of his elbow joint, as any bending or straightening of his elbow joint would change the orientation of the flywheel axis 304. In another example, the CMG 106 is still mounted to the wearer's forearm, but the flywheel axis 304 is positioned perpendicular to the bones in the wearer's forearm. This arrangement is shown in FIG. 3C, in which the orientation of the flywheel axis 304 is indicated by arrow 330. In this embodiment, if the wearer 100 bent his elbow so that his arm went into or out of the page, he would feel no resistance, since movement into our out of the page would not change the orientation of the flywheel axis 304. However, if the wearer bent his elbow so that his hand moved to the left or right across the page, as shown by arced arrow 332, he would feel a resistance, since movement across the page would change the orientation of the flywheel axis 304.

In some embodiments, rather than using actuators 106 positioned on limb segments, resistance is applied using dampers at the wearer's joints to resist motion. The dampers can be programmed to resist motion in certain directions, or to increase or decrease the resistance to motion depending on the position and motion of the wearer 100 as sensed by the sensors 202.

Figure 4:
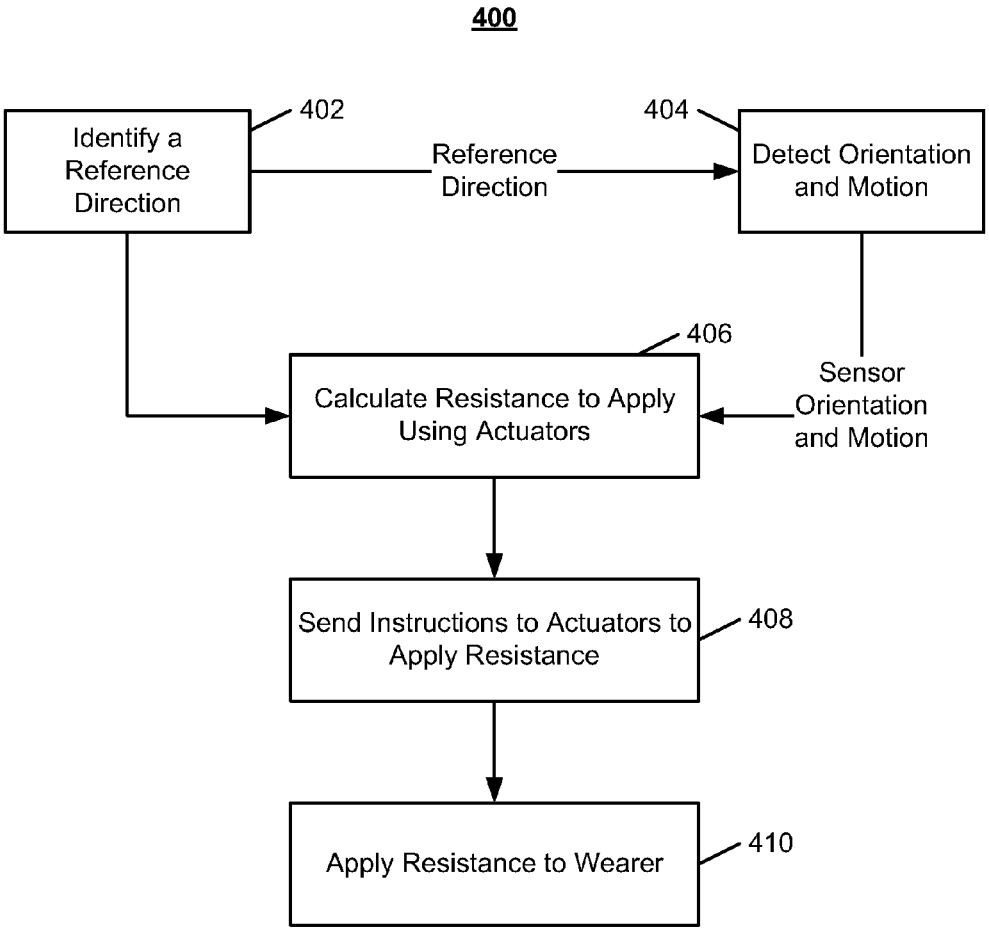
FIG. 4 shows a flowchart of a method for using the suit of FIG. 1 to apply resistance to the wearer, according to an illustrative embodiment of the invention.

FIG. 4 shows a flowchart of a method 400 for using the suit 102 described in relation to FIGS. 1 through 3 to apply resistance to a wearer of the suit 102. The method includes the steps of identifying a vertical direction (step 402), sensing the orientation and motion of the limbs with sensors 202 (step 404), determining a resistance to apply using the actuators (step 406), and sending instructions to the actuators to apply the resistance to the wearer (steps 408 and 410).

First, a reference direction is identified (step 402). If the suit 102 is used on Earth, the reference direction can be identified by directional sensor, such as a gravity sensor or a compass. Each sensor 202 can be connected to a directional sensor, or the suit 102 can have a single directional sensor. When the suit 102 is in space, these types of directional sensors may not work. In some embodiments, the wearer 100 can input a particular direction as the reference direction. For example, the wearer 100 can have a dial 111 on his belt or elsewhere on the suit for identifying a vertical direction. In other embodiments, the reference direction can be selected in the reference frame of the spaceship in which the wearer 100 is in or near, rather than the reference frame of the wearer himself. In this case, a vertical direction in the spaceship can be fixed or input by the wearer 100 and communicated to the processing unit 108. The reference direction is communicated to both the sensors 202 and the processing unit 108. If multiple people are wearing suits 102, one of the wearers may specify a reference direction, and the other suits 102 receive and use that reference direction for determining applied resistances.

The sensors 202 then detect their orientation with respect to the reference direction and the motion they experience (step 404). The sensors 202 communicate their observed orientation and motion to the processing unit 108. Since the sensors 202 and actuators 106 are attached to rigid support rods or rigid backings, the processing unit 108 can determine the orientation and motion of the actuators 106 from the detected orientation and motion of the sensors 202 with respect to the reference direction. From the orientation of the sensors 202 and/or actuators 106, the processing unit 108 determines the orientation of the wearer's limbs with respect to the reference direction. In some embodiments, the sensors 202 send not their orientation but rather their position. Form the relative positions of the sensors 202 and, the processing unit 108 determines the limb orientations. From the motion data from the sensors 202, the processing unit 108 can determine the trajectories of the wearer's limbs.

Based on the orientation of the wearer's limbs and the motion currently undertaken by the wearer 100, the processing unit 108 calculates resistances to apply using the actuators 106 to counteract an undesired motion, encourage a desired motion, and/or replicate the effect of gravity (step 406). The calculation of the resistances depends on the particular goal of the suit 408. For example, for replicating gravity in space, the processing unit 108 applies a constant "downward" resistance. If the wearer's limbs are continually moving, and if the gimbals of the CMG 106 were fixed, the orientation of the flywheels 302 would continually change with the movement of the wearer's limbs. So, the positions of the gimbals 306 and 310 are continually adjusted so that the orientation of the flywheels 302 remains constant with respect to the vertical direction. If the sensors 202 detect the orientation of the wearer's limbs and a motion currently being experienced by the sensors 202 at time t, the processing unit 108 can calculate expected orientations of the wearer's limbs at a time $t+\Delta t$. The processing unit 108 calculates the orientations to apply to the flywheels 302 for time $t+\Delta t$ based on the expected orientations of the wearer's limbs.

The processing unit 108 then sends instructions to the actuators to apply the calculated resistance (step 408). The calculated resistance includes a flywheel orientation and a flywheel speed. In the above example for replicating gravity, the flywheel speed is constant, and only the flywheel orientation is changed. In some embodiments, the instructions include positions of each of the gimbals. Based on the instructions, the actuators 106 apply the resistance to the wearer 100 (step 410), so that the wearer 100 feels the resistance if the wearer attempts to move in a resisted direction.

Figure 5:
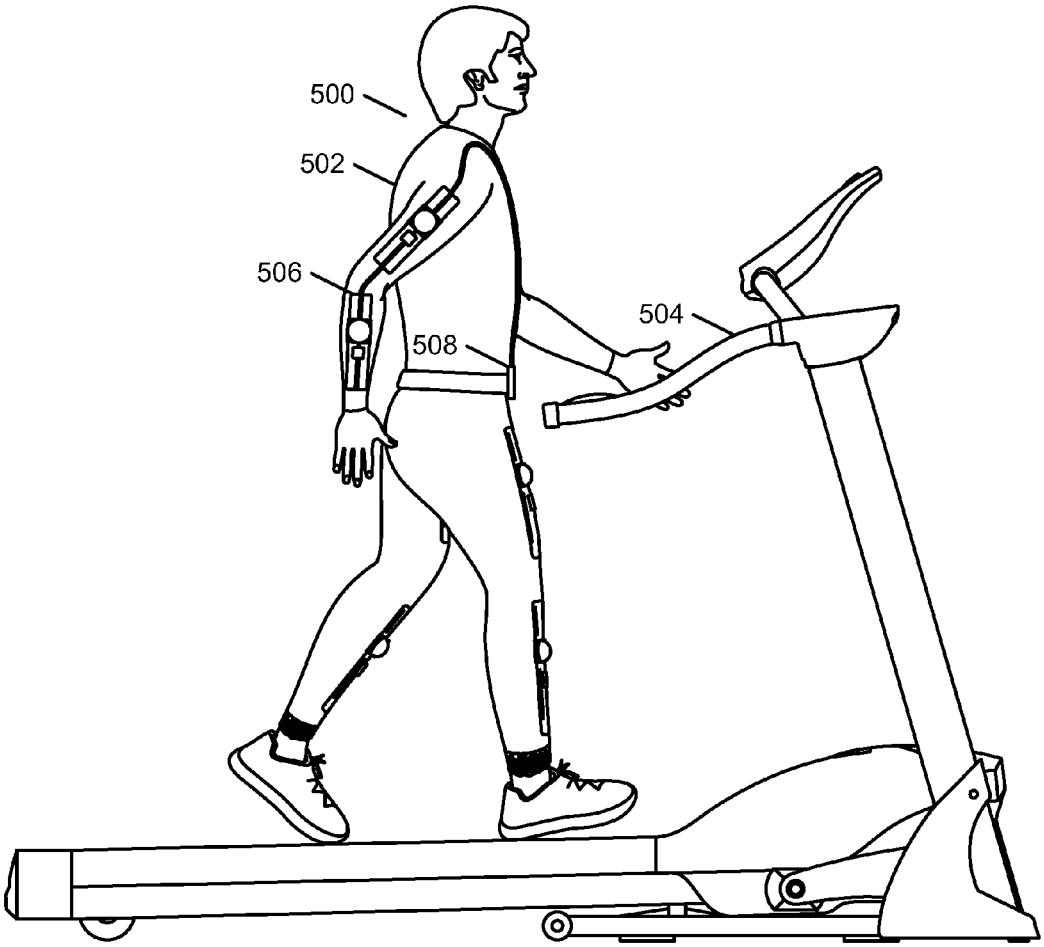
FIG. 5 shows a conceptual diagram of a person using the suit of FIG. 1 for physical therapy, according to an illustrative embodiment of the invention.

FIG. 5 shows an embodiment in which a wearer 500 is wearing the suit 502 while walking on a treadmill 504 for rehabilitation. In this case, rather than applying resistance to upwards motion, the suit 502 applies resistance to undesirable walking motions. The processing unit 508, which is similar to processing unit 108, accesses a file or database containing data relating to appropriate motions for walking. The data describes motions over a walking cycle consisting of, for example, a step with a left foot and a step with a right foot. The processing unit 508 is configured to determine the wearer's position in the walking cycle. The processing unit 508 then compares the wearer's position in the cycle to the desired limb motions and orientation at that point in the cycle to determine which motions which should be resisted. Instructions for enacting the determined resistances are sent to the actuator apparatuses 506, which position and rotate the flywheels 302 to apply the determined resistance to the wearer. By resisting undesired motions but providing no resistance for correct walking motions, the actuators provide a kinematic envelope of non-resistance for biomechanically desirable motions. In addition to providing feedback using resistance, the rehabilitation system may provide additional feedback using, for example, a display on the treadmill or a speaker. Kinematic envelopes of non-resistance can be programmed for training wearers to perform other types of motions, such as ballroom dancing, martial arts, figure skating, or other sports or physical activities that involve learning precise techniques.

In some embodiments, the applied resistances are calculated according to a training regimen for sensorimotor adaptation that becomes progressively more challenging. When a wearer of the suit 102 initially becomes exposed to a new environment (e.g., enters space) or begins a new physical training regimen (e.g., relearning how to walk, or learning ballroom dancing), the suit 102 initially applies small resistances and/or allows large errors to prevent the wearer 100 from getting discouraged or frustrated. Over time, the allowed error before resistance is applied is decreased or the strength of the resistance is increased, so that decreasing deviations from a trajectory are tolerated and the wearer's precision improves.

Figure 6:
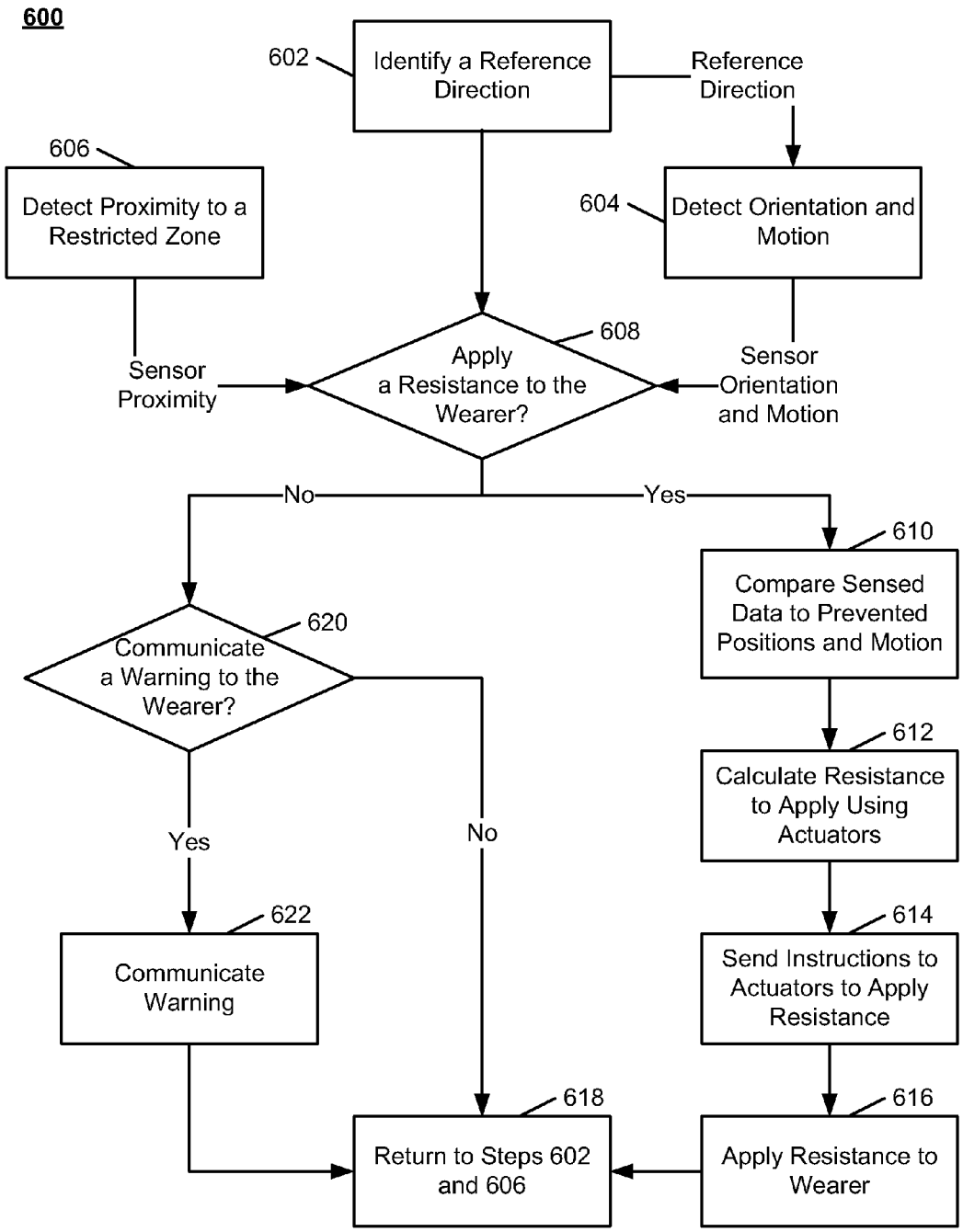
FIG. 6 shows a flowchart of a method for using the suit of FIG. 1 to provide a warning to a wearer when the wearer nears a restricted zone, according to an illustrative embodiment of the invention.

If the wearer 100 is working in a manufacturing setting, e.g., at an engine manufacturer, an automotive manufacturer, or an aircraft manufacturer, the wearer 100 may operate near hazardous machinery. Other hazards, such as harmful chemicals, lasers, explosives, and fires, exist in research and industrial settings. These and other dangers are best avoided to prevent personal injury and damage to equipment. To help a worker avoid dangerous machines and materials, the suit 102 can provide warning signs and/or resistance to a wearer 100 when the wearer 100 nears a particular hazard or "restricted zone." To accomplish this, the sensors 202 can include proximity sensors for determining a distance to the particular hazard. FIG. 6 shows a flowchart of a method 600 for using the suit of FIG. 1 to provide a warning to a wearer 100 when the wearer 100 nears a restricted zone.

The method 600 begins with identifying a reference direction (step 602) and detecting the orientation and motion with respect to the reference direction (step 604), which are similar to steps 402 and 404 described above. The sensors 202 also detect the proximity to a restricted zone (step 606). The restricted zone may emit a wireless signal that can be detected by the sensors 202. The strength of the signal weakens as the distance to the signal increases, so the distance to the restricted zone can be determined by the strength of the emitted signal. In an area with multiple hazards, the signal may include an identifier of the particular hazard (e.g., which machine the signal is sent from), the type of danger caused by the hazard (e.g., a chemical hazard or an equipment hazard), or a level of danger that the hazard poses (e.g., highly dangerous or moderately dangerous). In other embodiments, the locations of one or more restricted zones are known and stored on the processing unit 108 or an external processing system, and the processing unit 108 or external processing uses the data from the sensors 202 to perform dead reckoning and determine the positions of the sensors in relation to the restricted zone. Any other method or combination of methods for determining a distance to a restricted zone can be used.

After the proximity to the restricted zone has been determined, the processing unit 108 determines whether the suit 102 should apply a resistance to the wearer 100 (decision 608). In some embodiments, if the wearer 100 is very close to the restricted zone, or if the wearer 100 is moving in the direction of the restricted zone, the suit 102 should apply a resistance to the wearer 100 to prevent or resist further movement towards the restricted zone. In this case, the processing unit 108 compares the observed limb proximities, orientations, motions, or positions of the sensors 202 to the proximities, orientations, motions, or positions that the suit 102 is intended to prevent. Based on the comparison of the condition of the wearer 100 to the conditions the suit 102 is trying to prevent, the processing unit 108 calculates a resistance to apply using the actuators (step 612). The decision of whether to apply a resistance and/or how strong a resistance to apply can depend on the particular type of hazard posed by the restricted zone or the potential cost or inconvenience created by damage to equipment or materials when the wearer 100 enters the restricted zone. Once the processing unit 108 has determined a resistance to apply using the actuators, the processing unit sends the instructions to the actuators (step 614), and the actuators 106 apply the prescribed magnitude and direction of resistance (step 616). Steps 614 and 616 are similar to steps 408 and 410 described above in relation to FIG. 4. After the resistance has been applied or while the resistance is being applied, the method returns to steps 602 and 606 (step 618) to continually determine what resistance, if any, should be applied to the wearer 100.

If the wearer 100 is farther from the restrictive zone or is not moving towards the restricted zone, the processing unit 108 determines that a resistance need not be applied to the wearer 100. In this case, the processing unit 108 determines whether a warning should be communicated to the wearer 100 (decision 620). If the wearer 100 is not near the restricted zone or is moving away from the restricted zone, the suit 102 does not need to communicate a warning to the wearer 100, and the method returns to steps 602 and 606 to continually analyze the whether a resistance should be applied or a warning given to the user 100. If the wearer 100 is approaching the restricted zone or is in a reasonably close proximity to the restricted zone, the suit 102 can communicate a warning to the wearer 100 of his proximity to the restricted zone (step 622). In some embodiments, the warning is a pulsed resistance in the direction of the restricted zone. In such embodiments, if the wearer 100 moves in the direction of the restricted zone, the wearer 100 will feel the pulsed resistance. The pulsed resistance can be created by periodically speeding up and slowing down the flywheels 302. In other embodiments, the warning is an audio warning delivered by speakers, lights, or other suitable warning signals built into the suit 102 or external to the suit 102. After the warning has been given or while the warning is being given, the method returns to steps 602 and 606.

While preferable embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A wearable system for providing resistance to movement, the system comprising:

a plurality of wearable actuators configured to apply resistance to a wearer;

a plurality of first wearable sensors, wherein each of the plurality of first wearable sensors is configured to:

measure an indication of an orientation of a corresponding one of the plurality of wearable actuators with respect to a stored vertical direction, wherein the stored vertical direction is received from one of a second wearable sensor for identifying the vertical direction and a user interface with which the vertical direction can be input; and measure an indication of a motion experienced by the corresponding one of the plurality of wearable actuators; and a processor configured to:

receive data from each of the plurality of first wearable sensors indicative of the orientation and the motion;

determine an amount of resistance to apply using one of the plurality of wearable actuators based on the received data and the vertical direction; and send instructions to one of the plurality of wearable actuators that causes the wearable actuator to apply the determined resistance to the wearer.

2. The system of claim 1, wherein each of the plurality of wearable actuators is rigidly attached to a limb of the wearer.

3. The system of claim 2, further comprising at least one mounting beam for positioning proximate to the limb of the wearer, wherein one wearable actuator of the plurality of wearable actuators is mounted on the mounting beam for rigidly attaching the wearable actuator to the limb of the wearer.

4. The system of claim 1, wherein each of the plurality of first wearable sensors is further configured to measure indications of a magnitude and a direction of the motion.

5. The system of claim 1, wherein:

the processor is further configured to determine, based on data from each of the plurality of first wearable sensors, positions of each of the plurality of first wearable sensors in relation to each of the other sensors of the plurality of first wearable sensors, and determining the amount of resistance to apply using the one of the plurality of wearable actuators is further based on the relative position of the first wearable sensor corresponding to the one of the plurality of wearable actuators.

6. The system of claim 1, further comprising the second wearable sensor for identifying the vertical direction.

7. The system of claim 1, further comprising the user interface.

8. The system of claim 1, wherein the system further comprises a wearable power source coupled to the plurality of wearable actuators and the processor.

9. The system of claim 1, wherein the plurality of first wearable sensors and the plurality of wearable actuators are mounted on a body suit.

10. A wearable system for providing resistance to movement, the system comprising:

a plurality of wearable actuators configured to apply resistance to a wearer;

a plurality of first wearable sensors, wherein each of the plurality of first wearable sensors is configured to:

measure an indication of an orientation of a corresponding one of the plurality of wearable actuators with respect to a stored reference direction, wherein the stored reference direction is received from one of a second wearable sensor for identifying the reference direction and a user interface with which the reference direction can be input; and measure an indication of a motion experienced by the corresponding one of the plurality of wearable actuators; and a processor configured to:

receive data from each of the plurality of first wearable sensors indicative of the orientation and the motion;

determine an amount of resistance to apply using one of the plurality of wearable actuators based on the received data and the reference direction; and send instructions to one of the plurality of wearable actuators that causes the wearable actuator to apply the determined resistance to the wearer.

11. The system of claim 10, wherein the processor is further configured to cause the plurality of wearable actuators to limit the wearer from moving in a particular area.

12. The system of claim 11, wherein limiting the wearer from moving in the particular area comprises communicating a warning to the wearer indicating the danger of moving in the direction of the area.

13. The system of claim 12, wherein communicating the warning to the wearer comprises providing, by one or more of the plurality of wearable actuators, a pulsed resistance to movement in the direction of the area.

14. The system of claim 11, wherein limiting the wearer from moving in the particular area comprises providing, by one or more of the plurality of wearable actuators, resistance to movement in the direction of the area.

15. The system of claim 10, wherein the processor is further configured to cause the plurality of wearable actuators to provide a no-resistance envelope for a particular movement.

16. The system of claim 10, wherein the processor is further configured to cause the wearable actuators to provide a resistance curriculum to assist in physical rehabilitation of the wearer.

17. The system of claim 10, wherein the processor is further configured to cause the wearable actuators to assist in gait stabilization of the wearer.

* * * * *